US006053376A

United States Patent [19]

McGuffie

[11] Patent Number: 6,053,376

[45] Date of Patent: Apr. 25, 2000

[54] LINE MARKING SHOE

[76] Inventor: Iain Peter McGuffie, Hungry Hill Farm, Stoke Lacy, NR Bromyard, Herefordshire HR7 4HD, United Kingdom

[21] Appl. No.: 09/091,204

[22] PCT Filed: Sep. 20, 1996

[86] PCT No.: PCT/GB96/02323

§ 371 Date: Jun. 10, 1998

§ 102(e) Date: Jun. 10, 1998

[87] PCT Pub. No.: WO97/21871

PCT Pub. Date: Jun. 19, 1997

[30] Foreign Application Priority Data

Dec. 13, 1995 [GB] United Kingdom ..... 9525431

[51] Int. Cl.[7] ..... A01C 35/00

[52] U.S. Cl. ..... 222/611.1; 239/150

[58] Field of Search ..... 118/308, 315, 118/255; 222/611.1, 608, 402.17; 401/48; 239/150, 273

[56] References Cited

U.S. PATENT DOCUMENTS

| | | | |
|---|---|---|---|
| 1,814,488 | 7/1931 | Murnahan | 222/611.1 |
| 1,956,602 | 5/1934 | Went et al. | 222/608 |
| 2,127,852 | 8/1938 | Adamson | 222/611.1 |
| 2,317,288 | 4/1943 | McCubbin | 222/611.1 |
| 3,891,128 | 6/1975 | Thomas | 222/611.1 |
| 4,269,328 | 5/1981 | Franklyn | 222/611.1 |
| 4,545,531 | 10/1985 | Williams | 222/611.1 |

FOREIGN PATENT DOCUMENTS

| | | |
|---|---|---|
| 2326541 | 4/1977 | France . |
| 8805275 U | 7/1988 | Germany . |

*Primary Examiner*—Kevin Shaver
*Assistant Examiner*—Thach Bui
*Attorney, Agent, or Firm*—Ira S. Dorman

[57] ABSTRACT

A line marking shoe (1) adapted in use to be advanced relative to a ground surface in a line marking direction to mark a line onto the ground surface in the line marking direction (A) includes a sole part (3) having a discharge opening region (13) formed in it for discharge of line marking material onto the ground surface The discharge opening region includes a number of discharge opening areas and the discharge opening areas are so dimensioned and arranged that discharge of line marking material onto the ground surface through different discharge opening areas produces lines of different widths on the ground surface.

23 Claims, 2 Drawing Sheets

LINE MARKING SHOE

Figure 1:
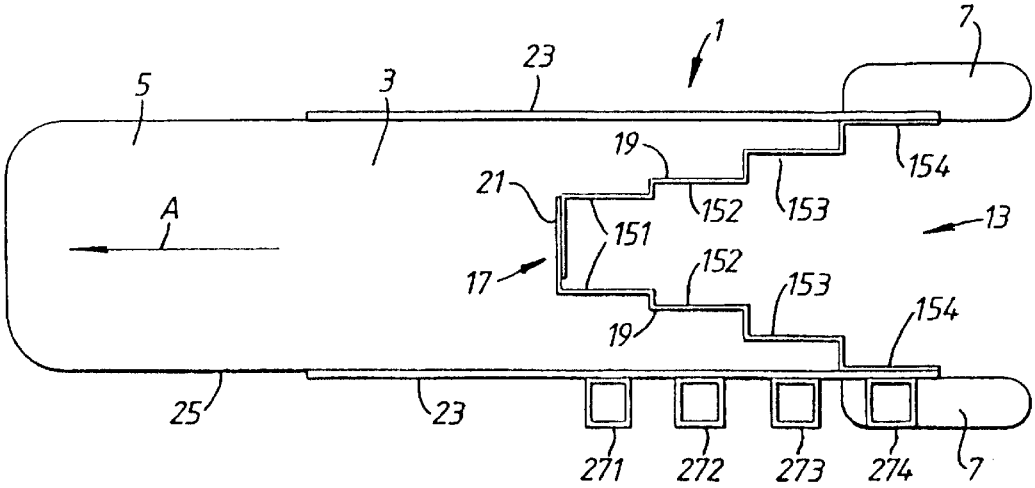

The present invention relates to line marking shoes which are advanced relative to a ground surface in a line marking direction to mark lines onto the ground surface in the line marking direction. Such shoes are principally, but not exclusively, advanced over the ground surface in the line marking direction by line marking apparatus and comprise a sole part having a discharge opening region formed therein for discharge of line marking material therethrough onto the ground surface and connector means for connecting line marking material supply means to the line marking shoe for supply of line marking material to the discharge opening region for discharge onto the ground surface.

There is at times a need for lines of different widths to be marked onto a ground surface. To achieve this end, it has hitherto been proposed to use a set of line marking shoes with each line marking shoe of the set having a discharge opening region adapted to mark a line of different width than that marked by the discharge opening regions of the other shoes of the set.

The disadvantage of this prior proposal is that it requires the laborious task of interchanging one line marking shoe of the set for another when lines of different widths are required to be marked onto the ground surface. This typically involves releasing the line marking material supply line from the line marking shoe being used in the line marking apparatus, releasing the line marking shoe from the line marking apparatus, connecting another line marking shoe to the line marking apparatus and connecting the line marking material supply line to the 'new' line marking shoe.

There has also hitherto been proposed a line marking shoe in which the dimension of the discharge opening region transverse to the line marking direction is adjustable to adjust the corresponding dimension of the line marking material deposited onto the ground surface and hence the width of the line marked. In this prior line marking shoe proposal the discharge opening region comprises an opening in the sole part through which line marking material is deposited onto the ground surface. The sole part further supports an upper part comprising a pair of spaced apart side walls which extend in a direction parallel or substantially parallel to the line marking direction to define a guide channel therebetween. The guide channel communicates at its lower end with the opening in the sole part and the connector means connects the line marking material supply line to the line marking shoe such that the line marking material is supplied through the guide channel to the opening in the sole part.

The side walls of the upper part in the prior line marking proposal are displaceable towards or away from one another. The dimension transverse to the line marking direction of the line marking material discharged onto the ground surface through the opening is therefore adjustable by adjusting the spacing between the side walls. The width of the line marked onto the ground surface is thus determined by the relative spacing between the side walls of the upper part.

The disadvantage of this prior line marking shoe proposal is that the need for displaceable side walls makes manufacture more involved and accordingly more expensive. Furthermore, control of the width of the line marked onto the ground surface is not as accurate as it could be. Moreover, a higher degree of maintenance than desired is required because the line marking material clogs up the means by which the side walls are displaceable towards or away from one another.

It is therefore an aim of the present invention to provide means for marking lines of different widths onto a ground surface which is simpler than the prior proposals.

According to the present invention there is provided a line marking shoe adapted in use to be advanced relative to a ground surface in a line marking direction to mark a line onto the ground surface in the line marking direction comprising a sole part having a discharge opening region formed therein for discharge of line marking material therethrough onto the ground surface, characterised in that the discharge opening region comprises a plurality of discharge opening areas and that the discharge opening areas are so dimensioned and disposed that discharge of line marking material onto the ground surface through different discharge opening areas produces lines of different widths on the ground surface.

In an embodiment of the invention hereinafter to be described the line marking shoe is provided with connector means for connecting line marking material supply means to the line marking shoe for supply of line marking material to the discharge opening region for discharge onto the ground surface and the connector means is adapted selectively to supply line marking material to any one of the discharge opening areas.

In an embodiment of the invention hereinafter to be described each discharge opening area has a dimension transverse to the line marking direction which is different than a corresponding dimension of each of the other discharge opening areas.

In an embodiment of the invention hereinafter to be described the sole part is formed with an opening which extends therethrough, the opening forms the discharge opening region and the discharge opening areas are areas of the opening. The discharge opening areas may be intercommunicating areas of the opening.

In an embodiment of the invention hereinafter to be described the opening is bounded by a pair of spaced apart side edges which extend in the line marking direction. When viewed in plan one of the side edges of the opening has a step profile and comprises a series of step sections, each step section in the side edge faces the opposite side edge, the space between each step section and the opposite side edge is different than the spaces between the other step sections and the opposite side edge and the space between each step section and the opposite side edge forms one of the discharge opening areas. Preferably, when viewed in plan the opposite side edge of the opening has a step profile and comprises a series of step sections, each step section in the opposite side edge faces a corresponding step section in the other side edge and the space between each pair of corresponding step sections forms one of the discharge opening areas. In this instance, the step profiles of the side edges may be such that the side edges converge towards one another in the line marking direction.

In an embodiment of the invention hereinafter to be described an upper part upstands from the sole part, the upper part comprising a pair of spaced apart side walls which extend in a direction parallel or substantially parallel to the line marking direction to define a guide channel therebetween which communicates at its lower end with the discharge opening region in the sole part, and the connector means connects the line marking material supply means to the line marking shoe such that it supplies line marking material through the guide channel to any one of the discharge opening areas.

In an embodiment of the invention hereinafter to be described the side walls of the upper part extend along and upstand from the opposite side edges of the opening and a transverse wall connects the side walls together at the forward ends thereof.

In another embodiment of the invention the sole part is formed with an opening and the lower end of the guide channel formed by the side walls of the upper part registers with a part of the opening, the part of the opening with which the lower end of the guide channel registers forming the discharge opening region with the discharge opening areas being areas of that part of the opening. If required, the discharge opening areas may be intercommunicating areas of the part of the opening. then viewed in plan the side walls of the upper part have a step profile with each side wall comprising a series of step sections. Each step section in one side wall faces a corresponding step section in the opposite side wall, and the space between each pair of corresponding step sections defines a guide sub-channel whose lower end communicates with one of the discharge opening areas. Optionally, the step profile in the side walls of the upper part is such that the side walls converge towards one another in the line marking direction.

In an embodiment of the invention hereinafter to be described the line marking material supply means supplies line marking material through a line marking nozzle and the connector means connects the line marking material supply means to the line marking shoe such that the line marking nozzle is positioned in the guide channel defined by the side walls of the upper part for supply of line marking material to any one of the discharge opening areas.

In an embodiment of the invention hereinafter to be described the upper part is an inner upper part and there is further provided an outer upper part having a pair of side walls spaced apart outwardly of the side walls of the inner upper part, the side walls of the outer upper part extending in a direction parallel or substantially parallel to the line marking direction and upstanding from opposite side edges of the sole part.

In an embodiment of the invention hereinafter to be described the connector means is adapted to releasably connect the line marking material supply means to the line marking shoe and the connector means is adapted to provide a plurality of predetermined positions for the line marking material supply means, each predetermined position providing for supply of line marking material to a predetermined different discharge opening area.

In an embodiment of the invention hereinafter to be described the connector means comprises an array of sockets mounted on one of the side walls of the outer upper part, each socket being adapted to receive plug means carried by the line marking material supply means to releasably connect the line marking material supply means to the line marking shoe, receipt of the plug means in one of the sockets positioning the line marking material supply line in one of the predetermined positions.

In an embodiment of the invention hereinafter to be described the sole part is adapted in use to support the line marking shoe on the ground surface and the longitudinal axis of the sole part is parallel or substantially parallel to the line marking direction.

In an alternative embodiment of the invention the sole part of the line marking shoe is formed with a plurality of discrete openings which extend therethrough and the discrete openings in the sole part collectively form the discharge opening region with each discrete opening forming one of the discharge opening areas.

According to the invention there is also provided a line marking assembly which includes a line marking shoe according to the invention.

According to the invention there is further provided a line marking apparatus including a line marking shoe according to the invention.

Figure 2:
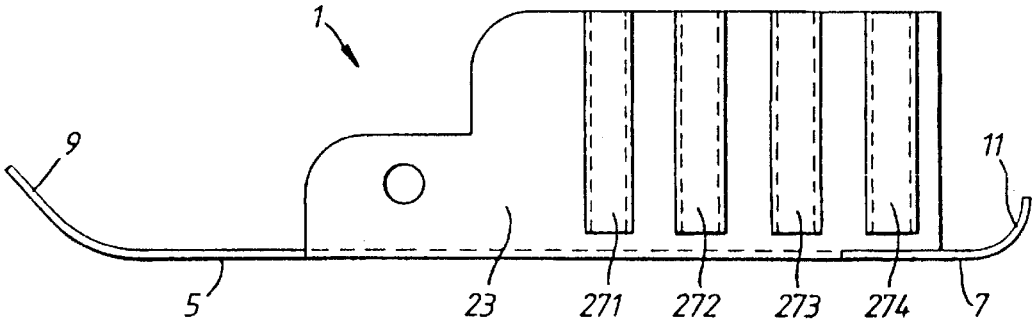
Figure 3:
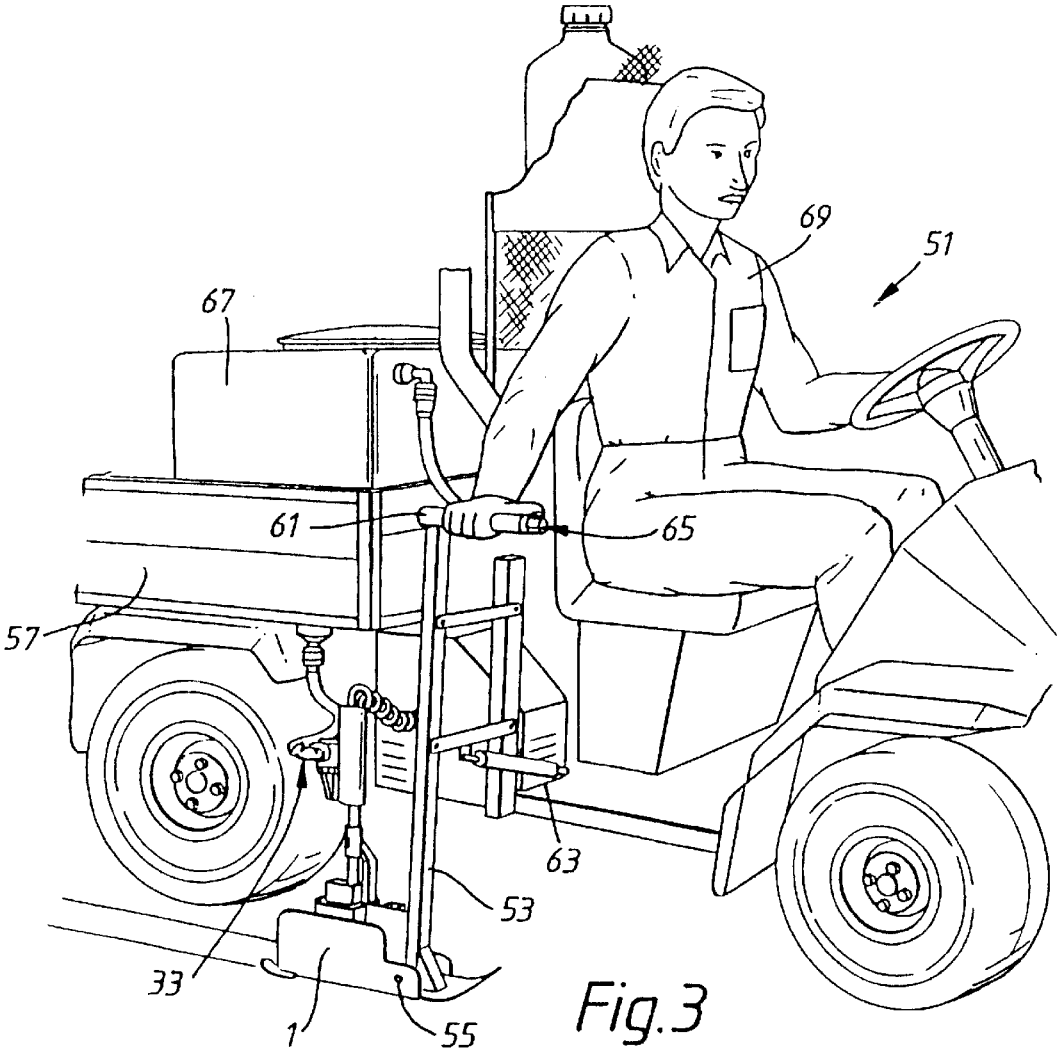
Figure 4:
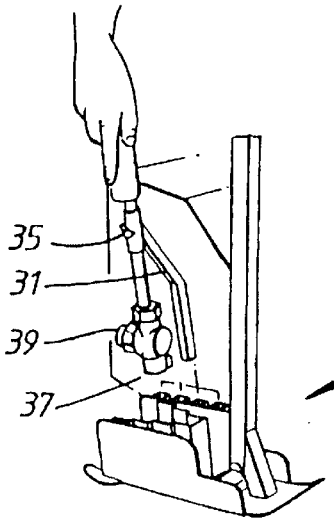

By way of example an embodiment of the invention will now be described with reference to the accompanying drawings in which:

FIG. 1 is a plan view from above of a line marking shoe according to the invention, FIG. 2 is a side view of the line marking shoe of FIG. 1, FIG. 3 is a schematic side view of line marking apparatus incorporating the line marking shoe of FIGS. 1 and 2, and FIG. 4 is an exploded schematic side view of the line marking shoe shown in FIG. 3.

Referring to FIGS. 1 and 2, there is shown a line marking shoe 1 comprising a sole plate 3 having a forward portion 5 and a rear portion 7. In use the sole plate 3 contacts a ground surface to be marked with a line and moves over the ground surface in a line marking direction A. To facilitate movement of the shoe 1 over the ground surface the forward end 9 of the forward portion 5 and the rear end 11 of the rear portion 7 of the sole plate 3 are configured to project upwardly away from the ground surface.

As can be seen from FIG. 1, the sole plate 3 is provided with an opening 13 in the rear end of the forward portion 5 of the sole plate 3. The side edges of the opening 13 have a step profile which results in the side edges converging towards one another in the line marking direction. The result of the step profile is further to form the opposite side edges into a series of side edge step sections 151, 152, 153 and 154 with each step section 151, 152, 153 and 154 in one of the side edges facing a corresponding step section 151, 152, 153 and 154 in the opposite side edge.

The spacing between each pair of corresponding side edge step sections 151, 152, 153 and 154 is different than that between the other pairs and constitutes a discharge opening area for discharge of line marking material onto the ground surface. As will be appreciated, each discharge opening area causes a line of different width to be marked onto the ground surface in consequence of each having a different width, that is to say, dimension transverse to the line marking direction.

Mounted on the sole plate 3 is an inner upper part 17 comprising a pair of spaced apart side walls 19 which extend along the opposite side edges of the opening 13 in the sole plate 3 and a transverse wall 21 which connects the side walls 19 together at the forward ends thereof.

The sides walls 19 of the inner upper part 17 define a guide channel therebetween which registers at its lower end with the opening 13 in the sole plate 3. As the side wails 19 have the same step profile as the side edges of the opening 13, the guide channel between the side walls 19 can be considered to be composed of a plurality of guide sub-channels, the lower ends of each of which registering with a different discharge opening area.

Also mounted on the sole plate 3 is an outer upper part comprising a pair of spaced apart side walls 23 which extend along the opposite side edges 25 of the sole plate 3. Attached to the outer surface of one of the side walls 23 of the outer upper part is an array of sockets 271, 272, 273 and 274. Each of the sockets 271, 272, 273 and 274 is adapted to releasably connect a line marking material supply line to the shoe 1 and position the line marking material supply line so that the line marking material dispensed thereby is selectively guided through eon the guide sub-channels for discharge through one of the discharge opening areas. The socket 271, 272, 273 or 274 selected to releasably connect the line marking material supply line to the line marking shoe thus determines the width of the line marked onto the ground surface.

The skilled reader will realise that the sockets 271, 272, 273 and 274 could instead be mounted on the inner upper part 17 with the outer upper part being omitted.

Referring now to FIGS. 3 and 4, there is shown a line marking apparatus 51 incorporating the line marking shoe 1 of FIGS. 1 and 2. The line marking shoe 1 is pivotally connected through a pivot point 55 to an outrigger structure 53 which in turn is connected to a vehicle 57 for transporting the line marking shoe 1 in the line marking direction.

The outrigger structure 53 includes a parallelogram linkage to enable the outrigger structure 53 to move between an expanded configuration, as shown in FIG. 3, and a contracted configuration. The outrigger structure 53 further includes an actuating handle 61 for manual movement of the outrigger structure 53 between its expanded and contracted configurations by a driver 69 of the vehicle 57.

When the outrigger structure 53 adopts the expanded configuration the line marking shoe 1 is deployed outwardly to its operational position for line marking. When,, on the other hand, the outrigger structure 53 adopts the contracted configuration the line marking shoe 1 is deployed inwardly to a retracted position which enables an obstacle on the axis of the line being marked to be passed without manoeuvring of the vehicle 57.

A supply of line marking material 67, in this case line marking liquid, is supported on the rear of the vehicle 57 and the line marking liquid is supplied to the line marking shoe 1 through a supply line 33 having an outlet end which is held by a screw 35 to a collar 31 which is releasably engagable in one of the sockets 271, 272, 273 and 274 carried by one of the side walls 23 of the outer upper part of the line marking shoe 1.

A pump pumps the marking liquid through the supply line 33 and the liquid supplied through the supply line 33 is sprayed into the line marking shoe 1 through a nozzle 37. Pumping can be effected by the power source of the vehicle 57 or by an independent source and a solenoid activated valve 39 is provided to regulate the flow from the nozzle 37 under the control of a switch 65 located on the handle 61 provided by the outrigger structure 53.

As can be seen, engagement of the collar 31 into one of the sockets 271, 272, 273 and 274 positions the nozzle 37 into one of the guide sub-channels. The discharge opening area through which the line marking liquid is discharged onto the ground surface thus depends on the socket 271, 272, 273, and 274 into which the collar 31 is engaged. As the width of each discharge opening area differs from the widths of the other discharge opening areas it follows that the width of the line marked onto the ground surface depends on which socket 271, 272, 273 and 274 the collar 31 is engaged in.

It will be appreciated that embodiments other than that described hereinabove with reference to FIGS. 1 to 4 are within the scope of the present invention.

For example, the sole plate 3 of the line marking shoe 1 could be formed with a plurality of spaced apart openings with each opening having a dimension transverse to the line marking direction which is different from a corresponding dimension of each of the other openings. In this example, each opening represents one of the discharge opening areas since each marks a line of different width onto the ground surface.

Alternatively, the lower end of the guide channel defined by the side walls 19 of the inner upper part 17 does not necessarily have to register with the whole of the opening 13 in the sole part 3. The opening 13 could be extended forwardly in the line marking direction so that the side walls 19 of the inner upper part 17 register with a part of the opening 13. In this example, the lower ends of the guide sub-channels formed by the spaces between the pairs of corresponding step sections in the side walls 19 constitute the discharge opening areas.

In addition, different cross-sections could be used for the opening 13 and/or inner upper part 17 to implement the invention. For example, an opening and/or inner upper part of triangular cross-section could be adopted.

It is to be understood that the further examples of the present invention outlined above are solely for the purpose of illustration and are not exhaustive.

I claim:

1. A line marking shoe (1) adapted in use to be advanced relative to a ground surface in a line marking direction to mark a line onto the ground surface in the line marking direction (A), the shoe comprising a sole part (3) having a discharge opening region (13) formed therein for discharge of line marking material therethrough onto the ground surface, the discharge opening region comprising a plurality of different discharge opening areas which are dimensioned and disposed so that discharge of line marking material onto the ground surface through different discharge opening areas produces lines of different widths on the ground surface wherein an upper part upstands from the sole part (3), the upper part comprising a plurality of spaced apart side walls (19) which extend in a direction parallel or substantially parallel to the line marking direction to define a guide channel therebetween which communicates at its lower end with the discharge opening region (13) in the sole part.

2. A line marking shoe according to claim 1, wherein the sole part (3) is adapted in use to support the line marking shoe (1) on the ground surface, the longitudinal axis of the sole part being parallel or substantially parallel to the line marking direction (A).

3. A line marking shoe according to claim 1 or 2, wherein each discharge opening area (13) has a dimension transverse to the line marking direction (A) which is different than a corresponding dimension of each of the other discharge opening areas.

4. A line marking shoe according to claim 1, wherein the side walls (19) of the upper part extend along and upstand from opposite side edges of the opening (13).

5. A line marking shoe according to claim 3, wherein the discharge opening areas are intercommunicating areas of the opening (13).

6. A line marking shoe according to claim 3, wherein the opening (13) is bounded by a pair of spaced apart side edges which extend in the line marking direction (A), one of the side edges of the opening when viewed in plan having a step profile and comprising a series of step sections (151, 152, 153, 154), each step section in the side edge facing the opposite side edge and the space between each step section and the opposite side edge being different than the spaces between the other step sections and the opposite side edge, the space between each step section and the opposite side edge forming one of the discharge opening areas.

7. A line marking shoe according to claim 6, wherein when viewed in plan the opposite side edge of the opening (13) has a step profile and comprises a series of step sections (151, 152, 153, 154), each step section in the opposite side edge facing a corresponding step section in the other side edge, the space between each pair of corresponding step sections forms one of the discharge opening areas.

8. A line marking shoe according to claim 7, wherein step profiles of the side edges are such that the side edges converge towards one another in the line marking direction (A).

9. A line marking shoe according to claim 1, wherein the sole part (3) is formed with a plurality of discrete openings which extend therethrough, the discrete openings in the sole part collectively forming the discharge opening region with each discrete opening forming one of the discharge opening areas.

10. A line marking shoe according to claim 1, wherein part (3) is formed with the lower end of the guide channel formed by the side walls (19) of the upper part with a part of the opening to form the discharge opening region with the discharge opening areas being areas of that part of the opening.

11. A line marking shoe according to claim 10, wherein when viewed in plan the side walls (19) of the upper part have a step profile with each side wall comprising a series of step sections (151, 152, 153, 154), each step section in one side wall facing a corresponding step section in the opposite side wall and the space between each pair of corresponding step sections defining a guide respectively whose lower end communicates with one of channel discharge opening areas.

12. A line marking shoe according to claim 11, wherein the step profile in the side walls (19) of the upper part is such that the side walls converge towards one another in the line marking direction (A).

13. A line marking shoe according to claim 1, wherein the upper part further comprises a transverse wall (21) which connects the side walls (19) together at the forwards ends thereof.

14. A line marking shoe according to claim 1 wherein the upper part forms an inner upper part (17) and there is provided an outer upper part having a pair of side walls (23) spaced apart outwardly of the side walls (19) of the inner upper part.

15. A line marking shoe according to claim 14, wherein the side walls (23) of the outer upper part extend in a direction parallel or substantially parallel to the line marking direction (A) and upstand from opposite side edges of the sole part (3).

16. A combination of a line marking shoe as claimed in claim 1 and a material supply means, wherein the line marking shoe (1) is provided with connector means (271, 272, 273, 274) for connecting line marking material supply means (67) to the line marking shoe for supply of line marking material to a respective one of the discharge opening areas.

17. A line marking shoe according to claim 16, wherein the connector means (271, 272, 273, 274) connects the line marking material supply means (67) to the line marking shoe (1) such that it supplies line marking material through the guide channel to any one of the discharge opening areas.

18. A line marking shoe according to claim 16, wherein the line marking material supply means (67) supplies line marking material through a line marking nozzle (37), the connector means (271, 272, 273, 274) connecting the line marking material supply means to the line marking shoe (1) such that the line marking nozzle is positioned in the guide channel defined by the side walls (19) of the upper part for supply of line marking material to any one of the discharge opening areas.

19. A combination according to claim 16 wherein the connector means (271, 272, 273, 274) is adapted to releasably connect the line marking material supply means (67) to the line marking shoe (1).

20. A combination according to claim 16 wherein the connector means (271, 272, 273, 274) is adapted to provide a plurality of predetermined positions for the line marking material supply means, each predetermined position providing for supply of line marking material to a predetermined different discharge opening area.

21. A combination according to claim 20, wherein the connector means (271, 272, 273, 274) comprises an array of sockets mounted on one of the side walls (23) of the outer upper part, each socket being adapted to receive plug means (31) carried by the line marking material supply means to releasably connect the line marking material supply means to the line marking shoe (1), receipt of the plug means in one of the sockets positioning the line marking material supply means in one of the predetermined positions.

22. A line marking assembly including a line marking shoe (1) according to claim 1.

23. A line marking apparatus including a line marking shoe (1) according to claim 1.

* * * * *